United States Patent [19]

Blümle

[11] Patent Number: 4,870,803

[45] Date of Patent: Oct. 3, 1989

[54] METHOD AND APPARATUS FOR PACKING ENVELOPES IN CARTONS

[75] Inventor: Martin Blümle, Horhausen, Fed. Rep. of Germany

[73] Assignee: Winkler & Duennebier Maschinenfabrik und Eisengiesserei KG, Neuwied, Fed. Rep. of Germany

[21] Appl. No.: 189,629

[22] Filed: May 3, 1988

[30] Foreign Application Priority Data

May 7, 1987 [DE] Fed. Rep. of Germany ..... 3715191

[51] Int. Cl.[4] ..... B65B 35/50

[52] U.S. Cl. ..... 53/447; 53/448

[58] Field of Search ..... 53/447, 448

[56] References Cited

U.S. PATENT DOCUMENTS

| | | | |
|---|---|---|---|
| 3,445,980 | 5/1969 | Solomon | 53/448 |
| 3,562,775 | 2/1971 | Mullins | 53/448 |
| 4,258,527 | 3/1981 | Steinbnecker | 53/448 |

FOREIGN PATENT DOCUMENTS 8632668 5/1986 Fed. Rep. of Germany .

*Primary Examiner*—W. Donald Bray

*Attorney, Agent, or Firm*—W. G. Fasse; D. H. Kane, Jr.

[57] ABSTRACT

The invention relates to a method and an apparatus for packing envelopes into cartons, cardboard boxes, and the like. The apparatus has a machine frame, a laying-down apparatus for individually arriving envelopes, a stacking stage, a filling station for filling the envelopes into the cartons or cardboard boxes, as well as invention is seen in that a table a forward and reverse slideable front stack support for envelopes placed successively one behind the other to be stacked, and a pusher member for pushing the stack with the stack support are provided. The stack support is arranged to detour around the envelopes to be boxed respectively during the return stroke, and the pusher member is arranged to detour around the stack being formed similarly respectively during the return stroke.

8 Claims, 11 Drawing Sheets

METHOD AND APPARATUS FOR PACKING ENVELOPES IN CARTONS

FIELD OF THE INVENTION

The invention relates to a method and an apparatus for packing envelopes into cartons, cardboard boxes or the like, with a machine frame, an envelope depositor for depositing individually arriving envelopes, with a stacking stage, a filling station for filling the envelopes into the cartons or cardboard boxes, and with drive means for the movable machine components.

DESCRIPTION OF THE PRIOR ART

An apparatus of the described type is, for example, known from U.S.-PS (U.S. Pat.) No. 3,562,775. In the stacking stage of the known apparatus, envelopes, which are continuously and successively deposited behind one another, are stacked and additionally separated into numerically equally sized groups, whereby an envelope at the end of each group is slightly pushed laterally out of place. The pushed-out envelope thereupon serves as a control means and operates as a control and for partition means, which divide the stack. The partition means are slidingly shifted and the motion of a carton to be packed is controlled. This carton is further placed over the numerically defined envelopes from above and for this purpose it is moved perpendicularly to the transport motion of the stacked envelopes. The further transport of the carton filled with envelopes is also achieved perpendicularly to the motion direction of the stacked envelopes.

OBJECT OF THE INVENTION

It is the object of the invention to provide an apparatus of It the-mentioned type which also completely automatically packs letter envelopes into cartons or cardboard boxes, whereby however, the possibility is retained that personnel operating the machine may also lay the envelopes into the boxes. Furthermore, an optical control by the machine operating personnel shall be possible at any time to make sure that all envelopes are correctly and orderly packed.

SUMMARY OF THE INVENTION

In order to achieve this object, the invention provides a table plate, a forward and reverse slidable front stacking support for envelopes placed successively behind one another to form a horizontal stack, and a pusher member which slidingly pushes the stack with the stack support. The stack support is arranged to detour around the envelopes to be boxed and the pusher member is arranged to detour around the next stack which is forming, respectively during the reverse stroke. The cartons or cardboard boxes in the boxing or filling station are slidable over the envelopes held between a stationary stack support and at least one holding member.

Contrary to the state of the art, the envelopes are transported for being boxed in defined groups between said front stack support and a pusher member. As soon as this has happened, the pusher member and the front stack support again return to their initial starting position in which the separately arriving envelopes are collated into a stack or a numerically exactly defined group between the front stacking support. Preferably brushes are arranged parallel to one another to serve as a holder. As soon as the stack has reached the desired size, the pusher member pushes the stack, preferably at first at a very high velocity and then at a reduced velocity in the direction toward the boxing station in which the carton is pushed over the collated envelopes. The starting velocity which is at first large, is necessitated by the stepping time of the envelopes which come individually out of an envelope depositor.

Further details of the invention are evident from the description and the claims in conjunction with the drawings.

BRIEF DESCRIPTION OF THE DRAWINGS

The invention will be more closely described below with reference to an example embodiment which is shown in the drawings, wherein.

Figure 1:
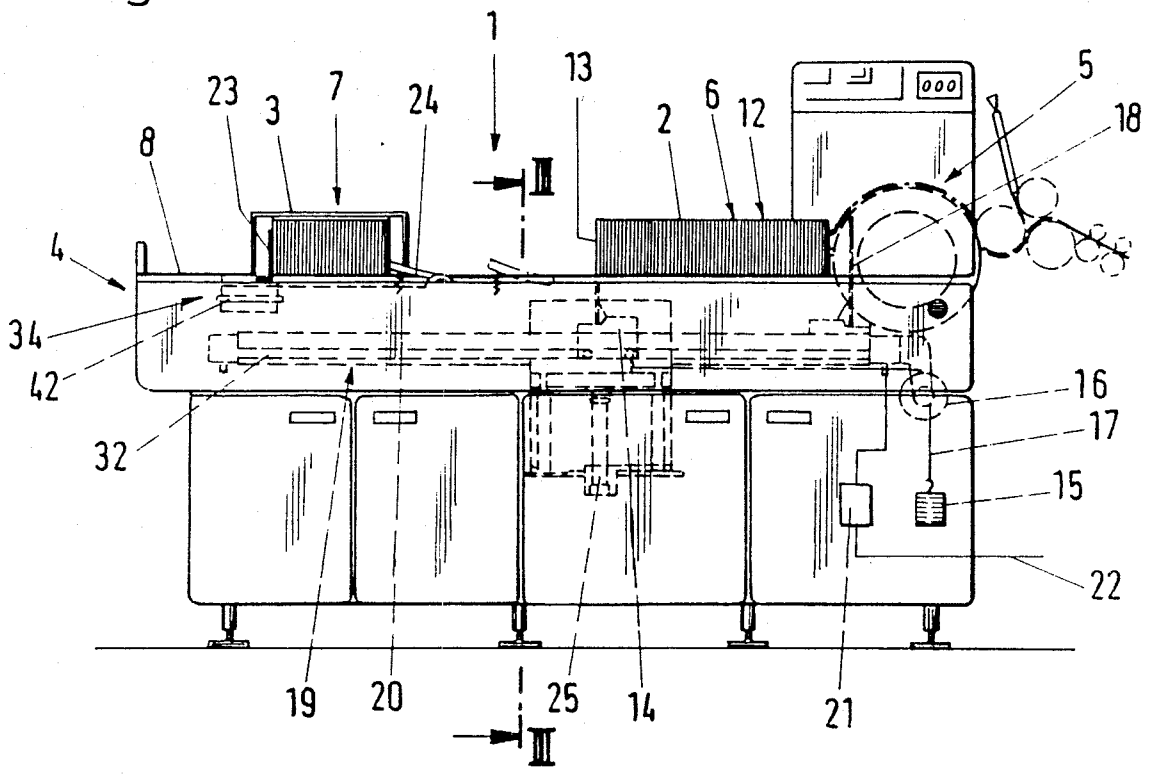
FIG. 1 shows a side view of an apparatus according to the invention for packing envelopes.

DETAILED DESCRIPTION OF PREFERRED EXAMPLE EMBODIMENTS AND OF THE BEST MODE OF THE INVENTION

An apparatus 1 for packing envelopes 2 into cartons 3, cardboard boxes or the like, includes a machine frame 4, an envelope depositor 5 for individually arriving envelopes 2, a stacking stage 6, a filling or boxing station 7 for filling the envelopes 2 into the cartons 3, and drive means for the moving parts.

The envelope depositor 5 places the envelopes 2 separately arriving from a conventional envelope manufacturing machine, not shown, onto a table plate 8 at the beginning of the stacking stage 6. In this area the stacking stage 6 may comprise brushes 9, 10 which are arranged parallel to one another as well as laterally next to a slit 11, which is located in the table plate 8. The two brushes 9, 10 then keep the envelopes 2 upright after they have been deposited. The envelopes 2 travel away from the envelope depositor 5 to make room for depositing more envelopes.

The two brushes 9, 10 have only a limited length in the stacking lengthwise direction, that is, in the horizontal direction since the stacks are formed horizontally. As soon as the stack 12 is longer than the brushes 9, 10 a freely slidably guided front stack support 13 (FIG. 1), which is urged by a constant force toward the envelope depositor 5, holds the envelopes 2, which are exiting from between the brushes 9, 10. The stack support 13 is located on a carriage 14 which is slidable on one side of the table plate 8 or rather on its underside in the lengthwise direction of the slit 11, whereby the stack support 13 reaches through the slit 11.

A freely suspended weight 15 is provided as the force, which steadily holds the stack support 13. The weight 15 is attached to the carriage 14 by a cable 17 guided over an idler roller 16. Furthermore, the apparatus 1 comprises a pusher member 18 which is slidable along the table plate 8 and which grasps the end of the stack 12 facing the envelope depositor 5 as soon as the stack 12 has the desired size. When an exactly defined number of envelopes 2 has been placed on the table plate 8 by the envelope depositor 5, the pusher member 18 pushes the stack 12 to the filling or boxing station 7 (FIG. 1) against the resistance of the stack support 13, which is loaded by the weight 15.

Figure 9:
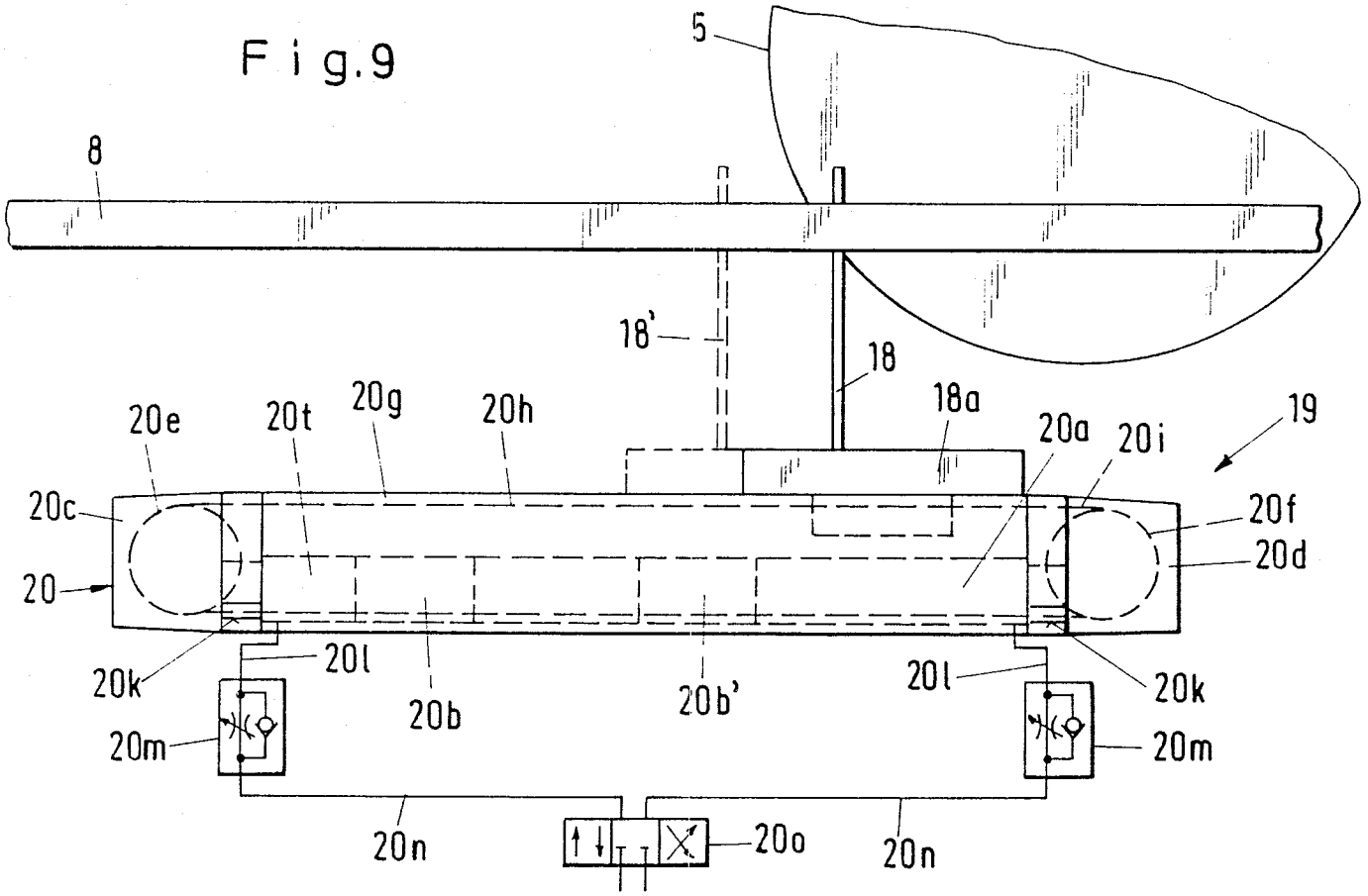
FIG. 9 shows a schematic sketch of the drive for the pusher member.

The pusher member 18 is movable by means of a piston cylinder apparatus 19. This piston cylinder apparatus 19 is located on the bottom of the table plate 8. The piston of this piston cylinder apparatus 19 does not comprise any piston rod. The cylinder 20 is slotted (FIG. 9). The function and manner of operation of the slotted, piston rodless cylinder 20 will be described below.

A controlled throttle valve 21 (FIG. 1) is arranged in the compressed air line 22 for the forward stroke leading to the slotted cylinder 20. The valve 21 is activated in such a manner that the pusher member 18 contacting the end of the stack 12 facing the pusher member leaves the envelope depositing area within the cycle time of the envelope depositor 5, that is to say, very quickly, whereupon the pusher member 18 pushes the stack 12 to the filling or boxing station 7 with a reduced, velocity. In the boxing station a stationary stack support 23 and, for example, a holding member 24, which is tiltably supported in the table plate 8 and is retractable and adjustable, take over the compressed stack 12 between them in such a manner that a carton or box 3 may be pushed onto the stack 12.

A holding member 24 is retractable so that the stack 12 is slidable without hindrance on the table plate 8 to the filling or boxing station 7.

For the return stroke, the movable stack support 13 and the pusher member 18 first simultaneously retract below the table plate 8 and then move back to their initial starting position in the area of the stacking stage 6. In that operation, the stack support 13 travels back under the filling or boxing station 7 and the pusher member 18 moves under the newly forming stack 12 to a waiting position at a spacing away from the brushes 9, 10. The waiting position is in front of the stack 12, that is in FIG. 1 to the right of the stack 12. Only after the stack support 13 and the pusher member 18 are again located in the area of the stacking stage 6 or in front of the envelope depositor 5 are they again moved upward and again reach through the slit 11 in the table 8.

Figure 3:
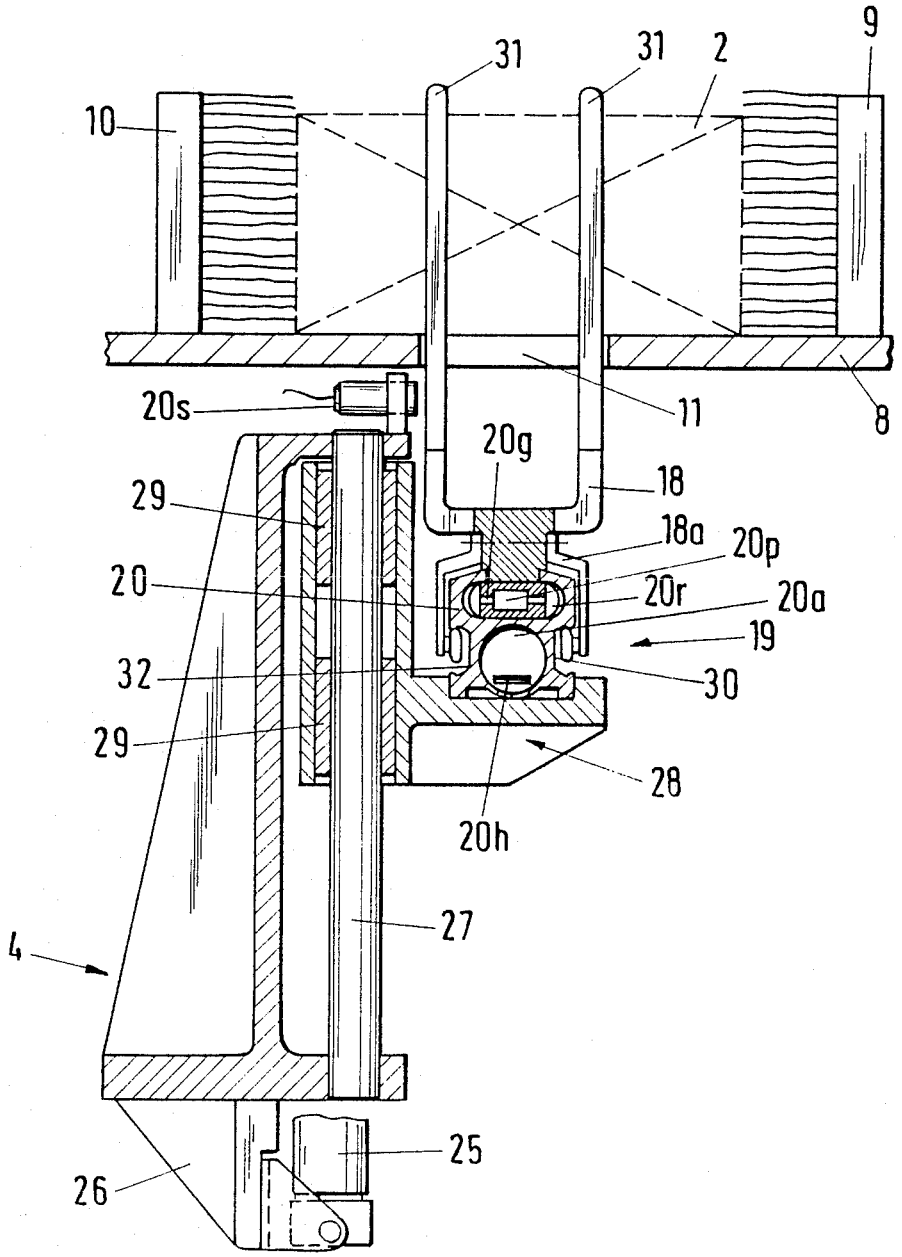
FIG. 3 shows a detail with the pusher member partly in section, and on a larger scale.
Figure 4:
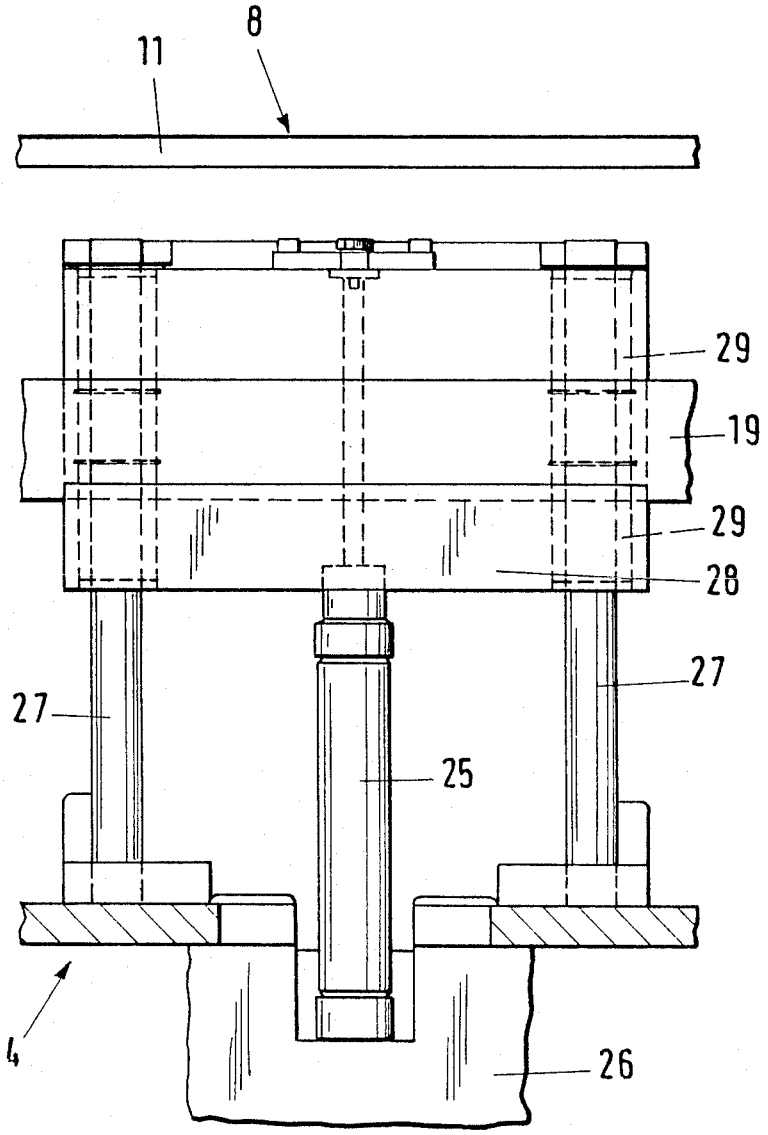
FIG. 4 shows a side view of portions of FIG. 3.

In order to remove the front stack support 13 and the pusher member 18 out of the path of motion of the stack 12, for the retracting and the lifting, their entire drive including the piston cylinder apparatus 19, is correspondingly retracted and lifted by means of a lifting apparatus 25 including a piston cylinder device which is supported by members 26 of the machine frame 4 as shown in FIGS. 3 and 4. Vertical guide rods 27 are provided for a carrier 28 on which the piston cylinder apparatus 19 for the pusher member 18 rests.

The piston cylinder apparatus 19 with the piston rodless cylinder 20 preferably extend horizontally or parallel to the table plate 8 and are arranged underneath the latter. The carrier 28 for the apparatus 19 is L-shaped in cross-section as shown in FIG. 3 and comprises guide bushings 29 for guidance along the guide rods 27.

The pusher member 18 is slidably guided (FIG. 3) on two sides in guide tracks 32 or grooves 32 outside on the piston rodless cylinder 20, for example, by means of arms or guide rollers 13. The pusher member 18 preferably reaches in a fork-shape with two separating fingers 31 through the slit 11 of the table plate 8.

A stationary stack support 23 is preferably embodied as a rear, two part, rigid stop respectively located outside of the slit 11. The separating fingers 31 of the pusher member 18 may be driven between the two parts of the support 23.

The carriage 14 with the front stack support 13 is also guided in the two guide tracks 32 (FIG. 1) of the piston rodless cylinder 20. The idler roller 16 is supported on the piston rodless cylinder 20 or at its one end, and is respectively lifted and retracted with the lifting and retracting of the cylinder 20 by the lifting apparatus 25.

The piston rodless cylinder 20 (FIG. 9) is a commercially available band cylinder with a cylinder bore **20*a* and a rodless piston 20*b* with head pieces 20*c* and 20*d* arranged on its end faces, with guide rollers 20*e* and 20*f*, with a slit 20*g*, and with bands 20*h* and 20*i* which connect the piston 20*b* with the pusher member 18, whereby the parts serving for guiding the pusher member 18 on the cylinder 20 are similarly embodied as carriages. As mentioned, the cylinder 20 with its piston 20*b* and the head pieces 20*c* and 20*d* or idler rollers 20*e* and 20*f***, etc. is a common commercially available component.

One band **20*h* extends from the pusher member 18, or rather its carriage 18*a* over the left idler roller 20*e* (FIG. 9) to the piston 20*b*. The other band 20*i* extends from the carriage 18*a* of the pusher member 18 over the right idler roller 20*f* to the piston 20*b*. Both bands 20*h* and 20*i* thereby extend through seals 20*k* before entering the interior of the cylinder bore 20*a*. The interior of the cylinder bore 20*a* is connected at both ends through conduits 201 to throttle check valves 20*m* which are connected through conduits 20*n* to a control valve 20*o*** and a pressure source not shown.

A braking device with a braking pressure generator **20*p* and brake shoes 20*r* is arranged on the carriage 18*a* so that the carriage 18*a* or the pusher member 18 is fixable at exactly defined positions or selectable positions by means of position sensors 20*s*, (FIG. 3**).

The use according to the invention of the piston rodless cylinder 20 is seen especially in that the piston **20*b* in its one end position according to FIG. 9, is located at a distance away from the left head piece 20*c* and thereby forms a cylindrical pressure chamber 20*t* at a spacing from the left end of the cylinder bore 20*a*. The piston 20*b* is held there by means of the braking device on the carriage 18*a* of the pusher member 18 while an excess pressure exists in the pressure chamber 20*t* and while a low pressure or atmospheric pressure exists on the other side of the piston 20*b*. In order that the pusher member 18 moves to the left in FIG. 9, in a quick impact-like manner in accordance with the cycle time of the envelope depositor apparatus 5. Thus, the pusher member 10 moves between two envelopes 2 which are to be deposited and the braking device of the carriage 18*a* is released so that the piston 20*b* slides very quickly to the right into the position 20*b*' in the cylinder bore 20*a*, whereby, the piston 20*b* pulls the carriage 18*a*** through the two bands 20h and 20i out of the region of the envelope depositor 5 and the pusher member 18 carries out the separation between two neighboring envelopes 2.

Subsequently, the carriage 18a with the pusher member 18 moves at a uniform velocity into preselected positions corresponding to the position of the position sensors 20s. The air streaming into the cylinder bore 20a is thereby controlled by means of the throttle check valve 20m. For a rapid return stroke of the pusher member 18, passage of compressed air through the other throttle check valve 20m is correspondingly controlled.

A mechanism 34 for turning and pushing out the cartons 3 filled with envelopes 2 (FIG. 2) belongs to the filling and boxing station 7. This mechanism 34 includes a tiltably arranged turning fork 35 and an ejector 36. The ejector 36, for example, includes a cylinder 37 with a piston and a piston rod 38, which, at its free end, carries a pressure piece 39 for engaging the carton 3.

Figure 5:
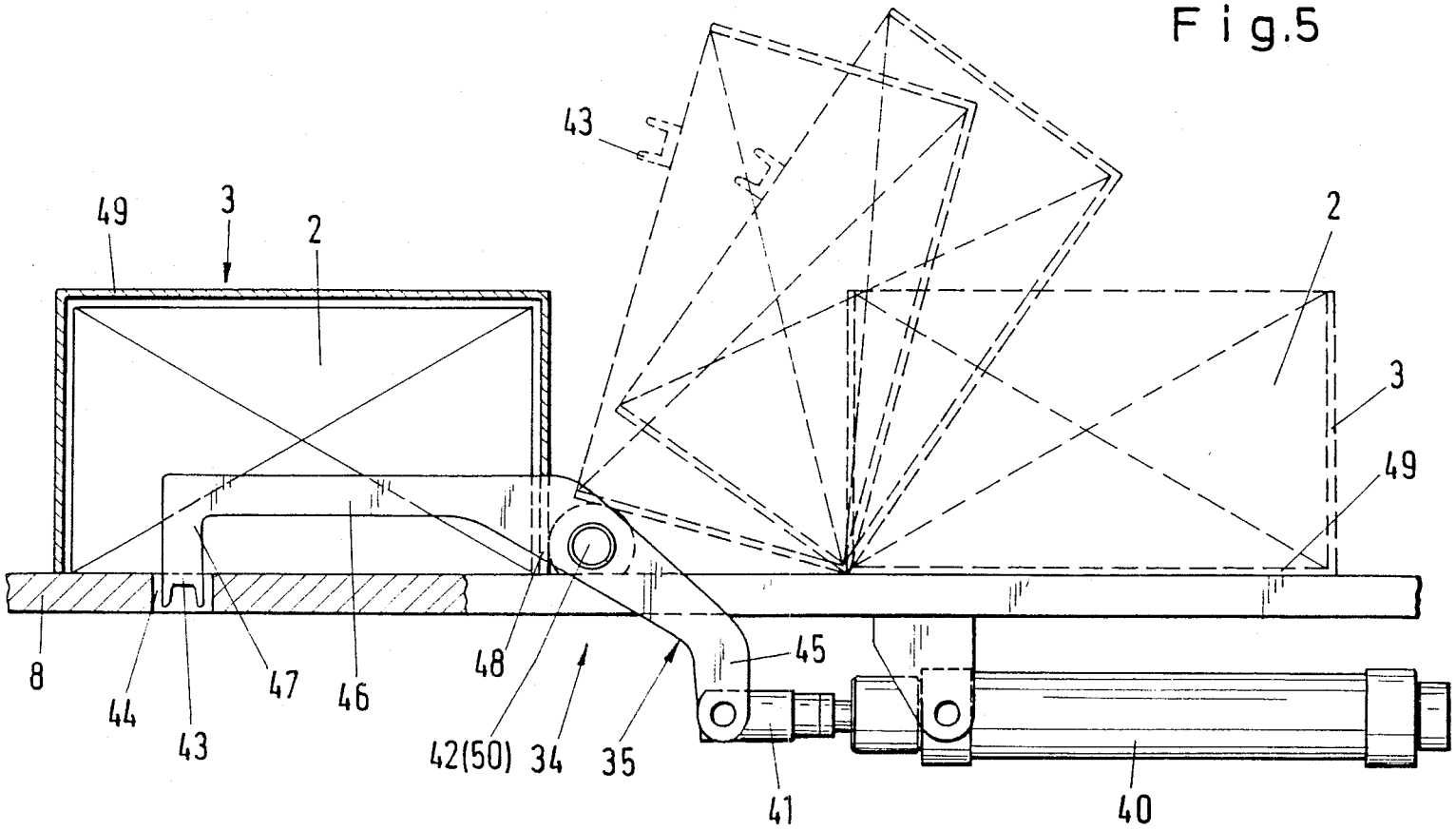
FIG. 5 shows, partially in section, a view of parts of a turning apparatus for the cartons.

In addition to a cylinder 40 (FIG. 5) with a piston and a piston rod 41 serving as a drive, the mechanism 34 for turning includes a turning fork 35 tiltably supported on an axis 42. The axis 42 is preferably located in a plane directly above the table plate 8 (FIG. 5). The turning fork 35 preferably includes a bar or rod shaped body which is angled or bent over several times and a rod-shaped carrier 43 which, for example, has a U-shaped cross-section and which in its resting position lies off-center in a slit 44 of the table plate 8 below the depositing position for the carton 3. The turning fork 35 further comprises two arms 45 and 46, whereby one arm 45, which is slightly bent at approximately its middle, extends from the axis 42 to the piston rod 41, while the other arm 46 leads from the axis 42 to the carrier 43. The fork 35 is connected to the carrier 43 by a respective right angled connecting intermediate piece 47. In the resting position according to FIG. 2 or FIG. 5 the arm 46 is located laterally next to the carton 3 and lifts it from underneath with the freely cantilevered carrier 43, whereby the carrier 43 simultaneously prevents the envelopes 2 from falling out of the carton 3. The filled carton 3 tips about its one open edge 48, which faces downwardly and which simultaneously is located near the axis 42 and lies in parallel to the latter.

During the turning procedure, the carrier 43 of the turning fork 35 lifts the carton 3 until it automatically tips further and finally comes to rest lying on its bottom surface 49. In order to prevent the carton 3 with its contents from sliding away during the lifting, a stop is provided in the area of the edge 48 of the carton 3. This stop is preferably an extension part 50 of the axis 42 of the turning fork 35 as can be seen by comparing FIGS. 2 and 5.

FIG. 5 also shows by dash-dotted lines various phases in the turning of the carton 3 from the position at the left with the bottom 49 facing upwardly and the position at the right with the bottom 49 facing downwardly.

The drive of the turning fork 35 with the cylinder 40 and its arm 45 are preferably located under the table plate 8. The axis 42 and its extension 50 preferably lie directly on the top surface of the table plate 8.

Figure 2:
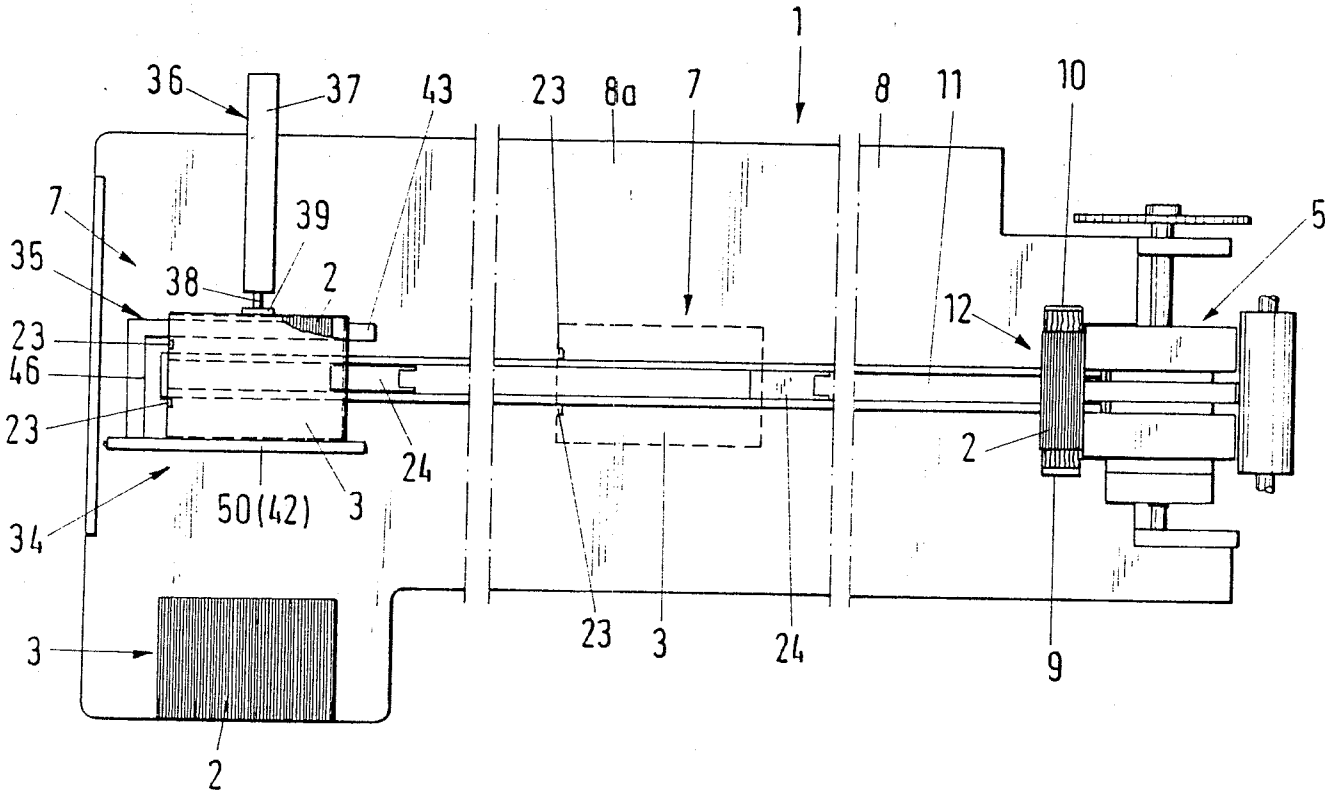
FIG. 2 shows a top view on another scale.

FIG. 2 also shows the possibility, by dashed lines, that the filling station 7 is arranged in front of the mechanism 34 for turning and ejecting as seen in the direction of motion. The filling station 7 and the turning mechanism 34 can be arranged at one location as is shown at the left of FIG. 2. However, the filling station 7 may also be located between the laying-down apparatus 5 with the stacking stage 6 and the turning mechanism 34. Then, the stationary stack support 23 and the holding part 24 are correspondingly arranged in the middle region of a table plate 8a, whereby the stationary stack supports 23 must also be retractable so that the carton which has been placed onto the envelopes 2 in the filling station 7, can be pushed along with the envelopes further toward the left in FIG. 2 until it comes into the turning mechanism 34. This pushing and shifting process may also be carried out by means of the pusher member 18 or by the piston rodless cylinder 20.

The spacially separated arrangement of the filling station 7 and the turning mechanism 34 is necessary when the specific form and shape of the carton makes this desirable.

Figure 6:
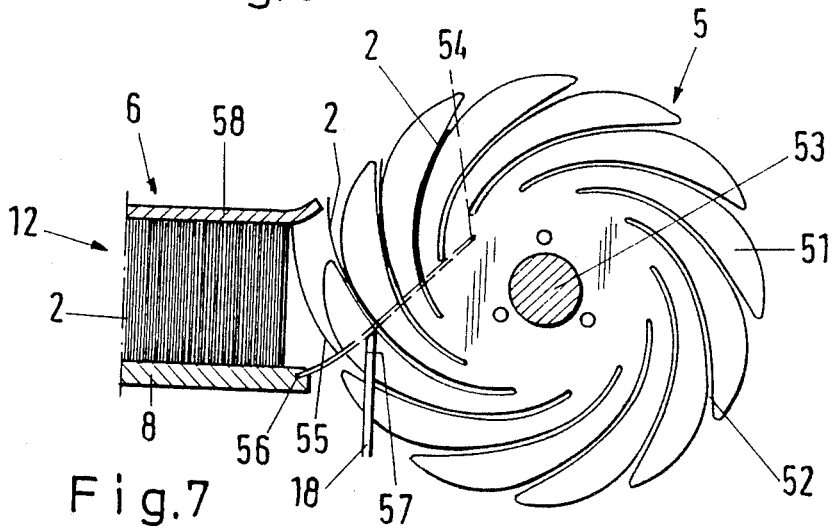
FIGS. 6–8 show basic sketches of an envelope depositor with the pusher member in various positions.
Figure 7:
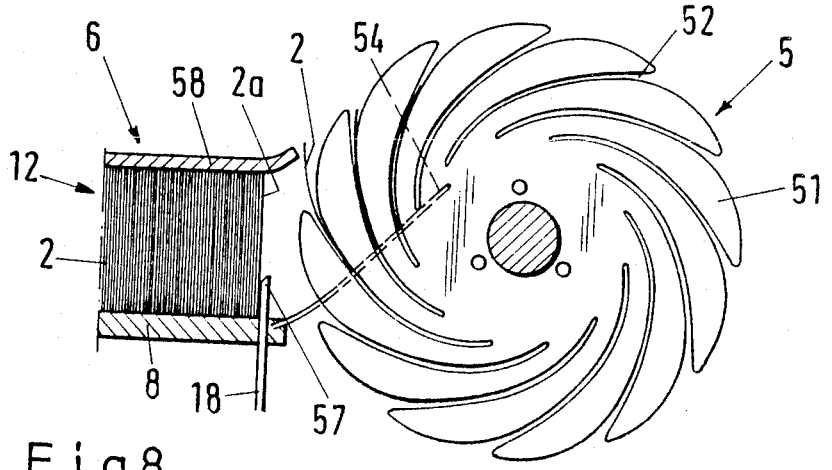
Figure 8:
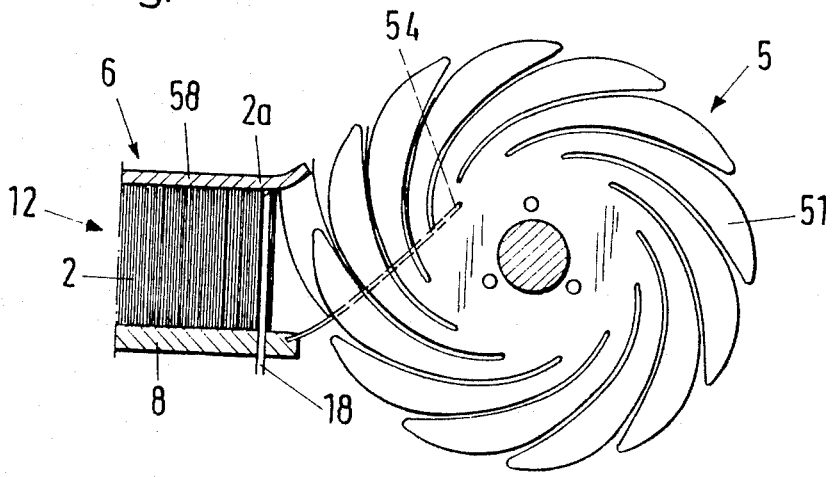

FIGS. 6 to 8 show, in a schematic representation, various positions of the pusher member 18 for an envelope depositor 5 with compartmentalized fan disks 51.

The compartmentalized fan disks 51 comprise slits 52 for receiving the envelopes 2 to be deposited and are attached to a shaft 53 driven at a constant rotational speed. At least one stripper 54 reaches between the compartmentalized fan disks 51 in a known manner and causes the envelopes 2 to glide with their lower edge 55 to the table plate 8. For this purpose the stripper 54 extends from the edge 56 of the table plate 8 diagonally upwardly between the compartmentalized fan disks 51.

The pusher member 18 is located with its upper edge 57 in the waiting position directly below the stripper 54, whereby the edge 57 preferably extends slightly higher than the level of the table plate 8. In the cycle time of the envelopes 2 to be deposited during the separating operation the pusher member 18 moves out of the position according to FIG. 6, at first horizontally to the left until reaching the stack 12 and slightly compressing the latter. This is shown in FIG. 7. From the waiting position according to FIG. 6 until the pusher member 18 contacts the stack 12, the pusher member 18 moves essentially only horizontally. However, basically, a vertical movement could simultaneously also be superimposed onto this horizontal movement As soon as the pusher member 18 contacts the stack 12, even if only with its upper edge 57 according to FIG. 7, a vertical movement is carried out until the pusher member 18 stands behind the envelopes 2 essentially over the entire height of the envelopes 2.

The horizontal movements of the pusher member 18 are carried out by means of the piston cylinder apparatus 19 while the lifting apparatus 25 performs the vertical movement of the pusher member 18.

At least one horizontally extending holding and guiding part 58 is located in the area of the stacking stage 6. This holding and guiding part 58 is arranged directly above the stack 12 or the deposited envelopes 2 and essentially serves as a stop. Part 58 ensures that envelopes 2 are not lifted up away from the pusher member 18 if the pusher member 18 contacts the last envelope 2a and additionally carries out a vertical movement. The holding and guiding part 58 then holds back the last envelope 2a or also the neighboring envelopes 2 and prevents that these are pushed up over the stack. It is advantageous if two battens extending in parallel to one another are provided as the holding and guiding part 58. The buttens are adjustable in their height, and if necessary, are spring loaded.

Figure 10:
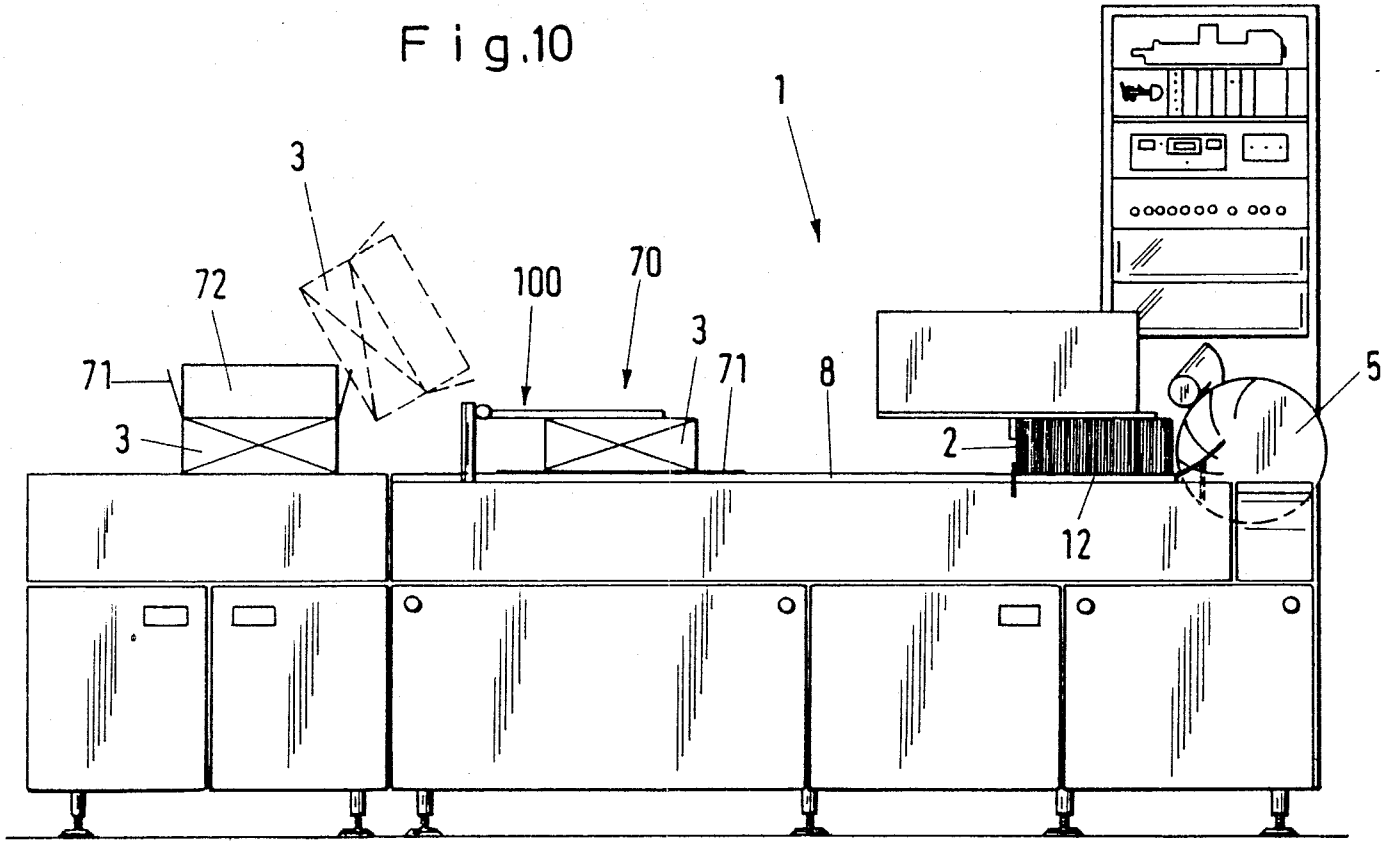
FIG. 10 shows a view as in FIG. 1, with a modified turning apparatus for the cartons.

FIG. 10 shows an apparatus 1 for packing individually arriving envelopes 2 in cartons 3 with an envelope depositor apparatus 5 and a different boxing or turning station 70 for the cartons 3 filled with envelopes 2.

Figure 12:
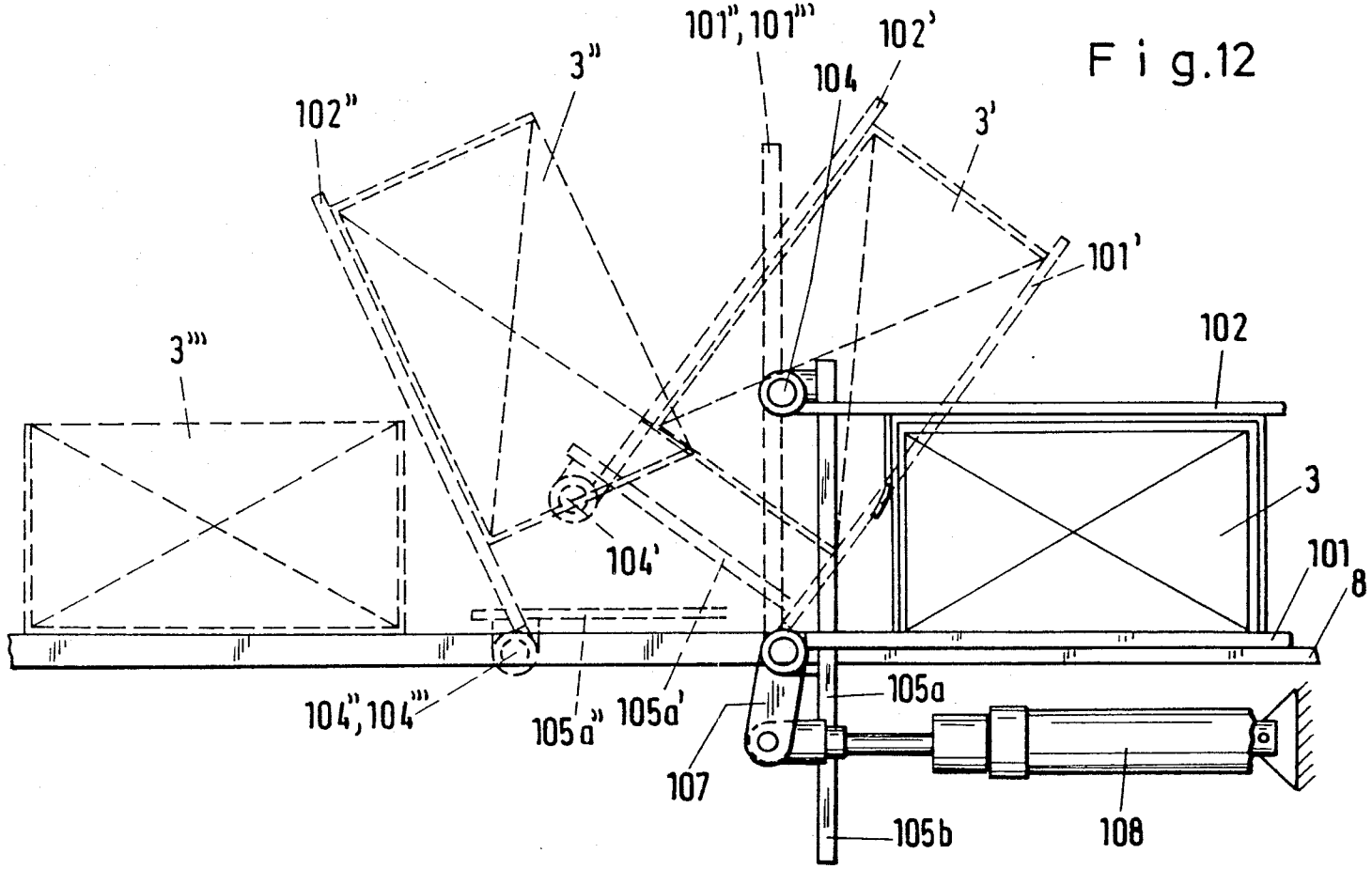
FIG. 12 shows details of the turning apparatus in various working stages.
Figure 13:
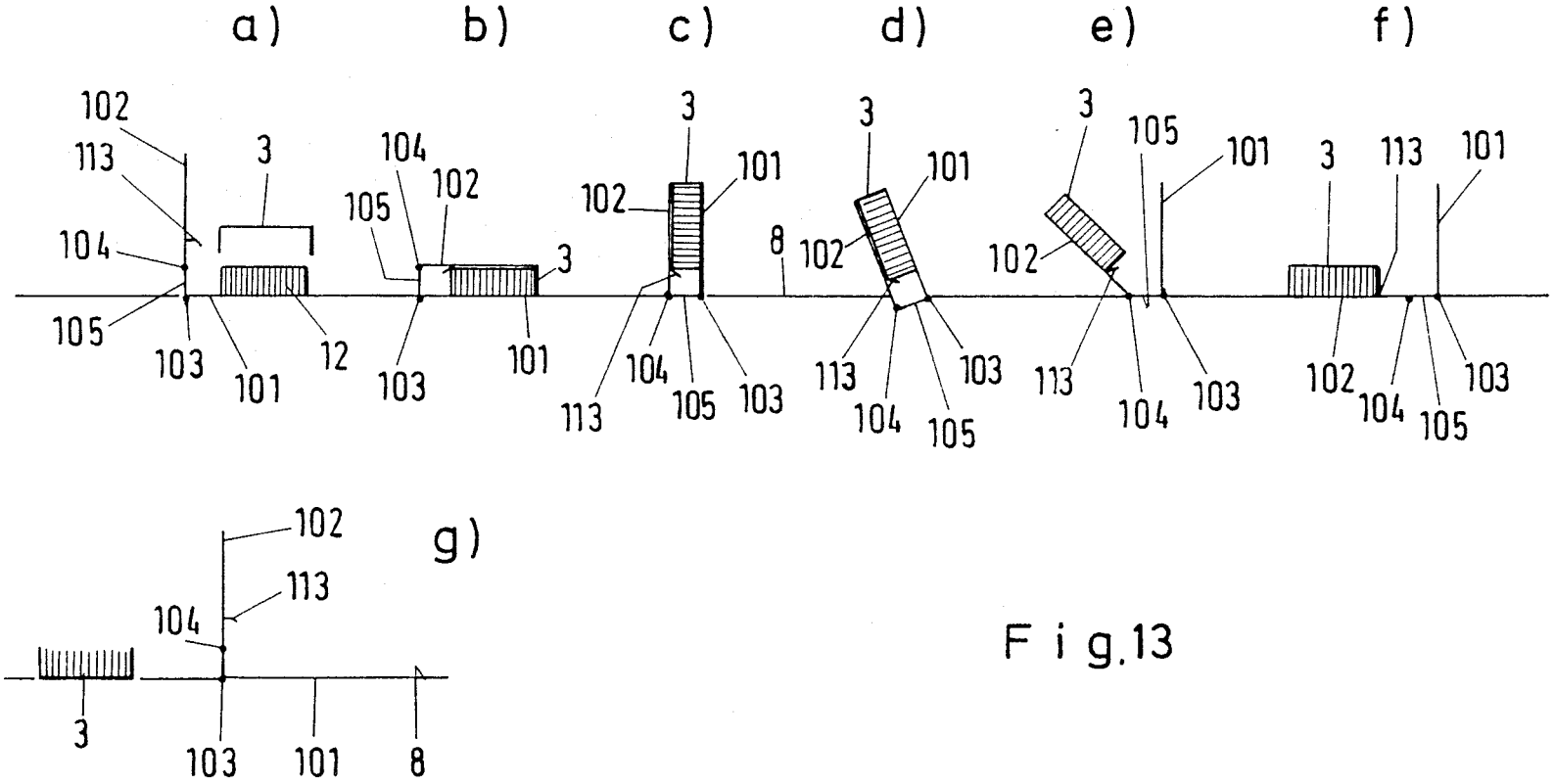
FIG. 13 shows a basic sketch with different views of various working stages of the turning apparatus corresponding to the FIGS. 10–12.

In the station 70, the cartons 3 are placed, for example by means of a robot not shown in FIG. 10, over the stacks 12 made up of envelopes 2 which have been pushed into the shown position, whereupon the cartons 3 are displaced by means of a turning device 100 in such a manner that the cartons 3 which were at first oriented with their opening downwardly, are turned over by 180° so that the opening or the closing flaps 71, 72 face upwardly as shown to the left in FIG. 10. Details of the turning device 100, which preferably works in the direction of movement of the stack 12 coming out of the laying-down apparatus 5, are shown in FIGS. 11, 12, and FIG. 13 with respect to the movement cycle.

The turning apparatus 100 comprises two, for example, fork-shaped carriers 101 and 102 arranged at a spacing from one another and adjustable relative to one another. Both carriers are together supported about an axis 103 relative to the table plate 8 in the apparatus 1. The fork-shaped carrier 102 is independently tiltably supported, about an axis 104 on an intermediate part 105, relative to the fork-shaped carrier 101. This intermediate part 105 has two arms 105*a* and 105*b* and is rigidly connected at a right angle to the fork-shaped carrier 101. The intermediate part 105 is rotationally rigidly arranged on a shaft 106 which forms the axis 103. A piston cylinder device 108, for example in the form of a pneumatic cylinder 108, pivoted to a lever 107, acts upon the shaft 106 through the lever 107. This cylinder 108 serves for the common tilting of the fork-shaped carriers 101 and 102.

The fork-shaped carrier 102 is rotationally rigidly attached to a shaft 109 which forms the axis 104. This shaft 109 is rotationally arranged or secured in a bearing 110 located at the free end of one arm 105*a* of the intermediate part 105. A lever 111 is rotationally rigidly arranged on the shaft 109 and is pivoted to a piston cylinder device 112, e.g., in the form of a pneumatic cylinder 112, which is similarly tiltably supported at the free end of the arm 105*b* of the intermediate part 105. By means of the piston cylinder device 112, the fork-shaped carrier 102 may be tilted about the axis 104 relative to the fork-shaped carrier 101 or to the arm 105*a* extending perpendicularly thereto. The fork-shaped carrier 102 is finally provided, at its free end, with a bent supporting part 113 or holding plate 113 which supports the full carton 3 during the rotating phase.

Figure 11:
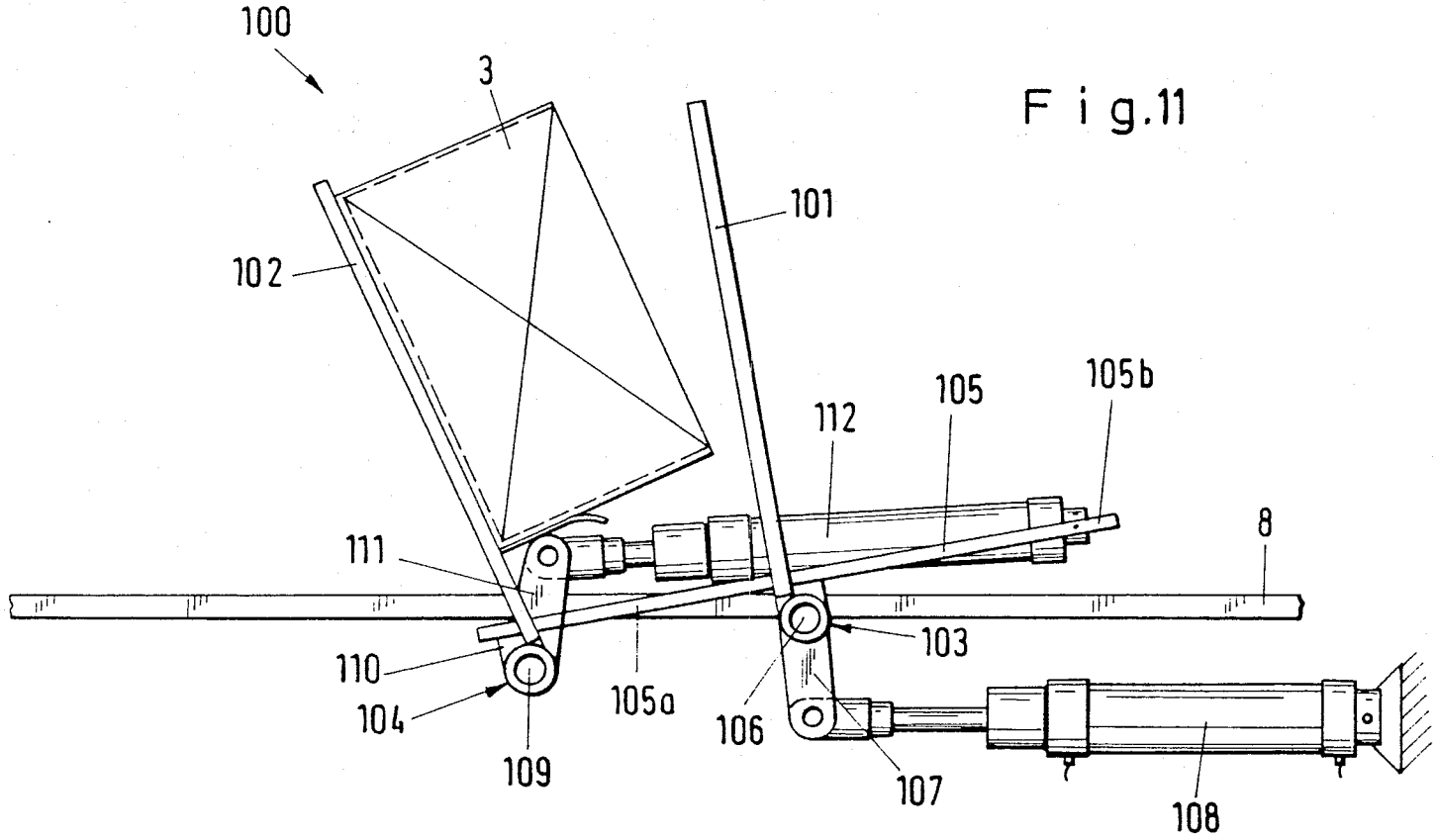
FIG. 11 shows details of the turning apparatus according to FIG. 10 during the turning operation.

The two arms 105*a* and 105*b* of the intermediate part 105 have approximately equal lengths and have an approximately T-shaped cross-section together with the fork-shaped carrier 101 according to FIG. 11. The lever 107 lies substantially as an extension of the fork-shaped carrier 101, whereby the axis 103 is arranged in such a manner in or under the table plate 8 that, according to a preferred embodiment, the fork-shaped carrier 101 may lie in the plane of the table plate 8 according to FIG. 13.

Various stages of the tilting or turning operation are shown in FIG. 12, whereby the same parts respectively have the same reference numbers, and have various indexes corresponding to the different positions.

The various views a to g of FIG. 13 show in a rather abstract manner, the motion cycle of the turning apparatus 100.

According to FIG. 13*a*, a stack 12 is standing in the boxing position. The fork-shaped carrier 102 is located in the plane of the table plate 8 below the stack 12. The carrier 102 is tilted by 90° upwardly into a vertical position The axis 104 is located vertically above the axis 103.

According to FIG. 13*b*, a carton 3 is placed upside down over the stack 12. The carrier 101 still lies in the plane of the table plate 8. The carrier 102 is tilted onto the carton 3 and lies parallel to the carrier 101. The axis 104 remains vertically above the axis 103. The carton 3 with the stack 12 is located between the two carriers 101 and 102, whereby the supporting part 113 or holding plate 113 laterally contacts the carton 3 in the left side of FIG. 13*b*. The intermediate part 105 or its one arm 105*a* defines the spacing of the two carriers 101 and 102 lying parallel to one another.

According to the view in FIG. 13*c*, the filled carton 3 is tilted upwardly by 90° and is supported from below by the supporting part 113 or the holding plate 113. The two fork-shaped carriers 101 and 102 extend upwardly in parallel and at 90° to the plane of the table plate 8. The axis 104 is tilted into the plane of the table plate 8.

According to FIG. 13*d*, the carton 3 with its contents is located in a position of approximately 120° relative to the view of FIG. 13*a*. The two fork-shaped carriers 101 and 102 still extend in parallel to one another. The axis 104 is now located below the plane of the table plate 8.

According to FIG. 13*e*, the fork-shaped carrier 101 is tilted back into a position perpendicular to the plane of the table plate 8, whereby the intermediate part 105 rigidly connected to the carrier 101 has again been lifted in the clockwise direction and the axis 104 now lies in the plane of the table plate 8 The carton 3 with its contents is carried by the fork-shaped carrier 102 and the support part 113.

According to FIG. 13*f*, the fork-shaped carrier 101 is still standing perpendicularly to the plane of the table plate 8. The fork-shaped carrier 102 has moved the carton 3 with its contents and with the opening facing upwardly into a horizontal plane, where it may place the carton onto a further transporting conveyor belt or the like not shown. The axis 104 still lies in the plane of the table plate 8.

According to FIG. 13*g*, the carriers 101 and 102 have been tilted back into their initial starting position as in FIG. 13*a*, whereby the carrier 101 lies in the plane of the table plate 8 and the carrier 102 stands perpendicularly to the plane of the table plate 8. The axis 104 is again located vertically above the axis 103.

The entire motion cycle is achieved by means of a respectively appropriately timed control of the two piston cylinder devices 108 and 112, and thereby allows the turning over of a carton lying with its opening facing downwardly on top of a stack, whereby the turning process may also entail more or less than 180°. For turning over stacks 12, or cartons 3 with contents, or any desired body, the turning apparatus 100 comprises the carrier 101 arranged on the bottom side in the initial starting position, and the tiltable carrier 102 which may be placed on top of the body or carton 3. The carriers are connected with one another by the intermediate part 105 or 105*a*. The carriers are tiltable together or they are tiltable relative to one another so that both carriers 101 and 102 may be tilted from a parallel position relative to one another according to FIG. 13*b* and from a common tilted parallel position relative to one another according to FIGS. 13*c* and 13*d* into an opened position according to FIGS. 13*a*, 13*e*, 13*f*, and 13*g*.

The invention is not limited to the example embodiment shown in the Figures because variations are possible without deviating from the basic idea of the invention. Thus, it is, for example, possible that the stack support 13 and the pusher member 18 are moved back into the initial starting position laterally next to a complete stack or a newly forming stack and not underneath the table plate 8 as is shown in the Figures.

Although, the invention has been described with reference to specific example embodiments, it will be appreciated, that it is intended to cover all modifications and equivalents within the scope of the appended claims.

I claim:

1. A method of packing envelopes into cartons, cardboard boxes, or the like, comprising the following steps:

(a) depositing envelopes one behind the other in a substantially upright on-edge position on a stacking stage for forming a stack of envelopes on said stacking stage;

(b) moving said stack by means of a pusher member over a first short path distance at a high speed;

(c) moving said stack over a second longer path distance at a low speed, which is slower than said high speed, to a boxing station;

(d) placing a carton, box, or the like over said stack in said stacking station; and (e) moving said carton together with said stack of envelopes away from said boxing station.

2. The method of claim 1, further comprising keeping said pusher member waiting in a waiting position at a distance away from said stacking stage prior to moving said stack.

3. The method of claim 2, further comprising moving said pusher member under said stack being formed by said depositing of envelopes on said stacking stage, for bringing said pusher member into said waiting position.

4. The method of claim 2, further comprising moving said pusher member from said waiting position to contact said stack and then vertically upwardly along said stack within a cycle time, whereupon said pusher member carries out said moving of said stack.

5. The method of claim 1, further comprising braking and holding, in a starting position, a rodless piston of a rodless piston cylinder device a distance away from an end head-piece of said piston cylinder device, thereby forming a pressure chamber, maintaining excess pressure in said pressure chamber, and releasing said braking and holding of said rodless piston to drive said pusher member for moving of said stack first at said high speed and then at said lower speed.

6. An apparatus for packing envelopes into cartons, cardboard boxes, or the like, comprising a machine frame, means for depositing envelopes, a stacking stage, a boxing station for filling stacked envelopes into said cartons or cardboard boxes, a pusher member (18) for pushing a stack of said envelopes, drive means for operating said pusher member, said drive means including a rodless piston cylinder device (19) including a cylinder (20) and a rodless piston (**20*b*) slideably arranged in said cylinder (20), end caps (20*c*, 20*d*) arranged at respective opposite ends of said cylinder, a guide roller (20*e*, 20*f*) arranged at each of said end caps, at least one tension means (20*h*, 20*i*) attached to said piston and passing out of said cylinder through said end caps and over said guide rollers, said apparatus further comprising a carriage (18*a*) carrying said pusher member (18**) and connected by said tension means to said rodless piston for operating said pusher member, brake means operative on said carriage for holding said carriage at selectable positions, and position sensor means for selecting said selectable positions of said carriage, said brake means being responsive to said position sensor means, whereby said piston can be held in a starting position by said brake means, said piston in said starting position being spaced from one of said end caps for forming a pressure chamber between said piston and said one end cap.

7. The apparatus of claim 6, wherein said means for depositing envelopes comprise at least one compartmentalizing fan-type disc and stripper means arranged to strip envelopes from said fan-type disc.

8. The apparatus of claim 6, further comprising lifting means (25) for moving said carriage (**18*a***) of said pusher member and said drive means of said pusher member up into an operating position and down into a retracted return position.

* * * * *

UNITED STATES PATENT AND TRADEMARK OFFICE

CERTIFICATE OF CORRECTION

PATENT NO. : 4,870,803

DATED : October 3, 1989

INVENTOR(S) : Martin Bluemle

It is certified that error appears in the above-identified patent and that said Letters Patent is hereby corrected as shown below:

Abstract, line 6, delete "invention".

Signed and Sealed this

Twenty-third Day of October, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,870,803

DATED : October 3, 1989

INVENTOR(S) : Martin Bluemle

It is certified that error appears in the above-identified patent and that said Letters Patent is hereby corrected as shown below:

In the Abstract [57]:

line 7, replace "is seen in that a table a" by --with drive devices for the moving parts. A--.

Signed and Sealed this

Seventh Day of January, 1992

*Attest:*

HARRY F. MANBECK, JR.

*Attesting Officer*

*Commissioner of Patents and Trademarks*